United States Patent [19]

Coté et al.

[11] 4,097,220

[45] Jun. 27, 1978

[54] FLASH LAMP ARRAY HAVING SHORTING LAMPS

[75] Inventors: Paul T. Coté, Cleveland Heights; Lewis J. Schupp, Chesterland, both of Ohio

[73] Assignee: General Electric Company, Schenectady, N.Y.

[21] Appl. No.: 724,014

[22] Filed: Sep. 16, 1976

[51] Int. Cl.[2] ..... F21K 5/02

[52] U.S. Cl. ..... 431/95 A; 431/95

[58] Field of Search ..... 431/95, 95 A

[56] References Cited

U.S. PATENT DOCUMENTS

| | | | |
|---|---|---|---|
| 3,602,619 | 8/1971 | Van der Tas et al. | 431/95 |
| 3,685,947 | 8/1972 | Meulemans et al. | 431/95 |
| 3,692,995 | 9/1972 | Wagner | 431/95 |
| 3,721,515 | 3/1973 | Boekkooi et al. | 431/95 |
| 3,752,636 | 8/1973 | Warninck | 431/95 |

*Primary Examiner*—Carroll B. Dority, Jr.
*Attorney, Agent, or Firm*—Norman C. Fulmer; Lawrence R. Kempton; Frank L. Neuhauser

[57] ABSTRACT

A sequencing flash array having flash lamps which are short-circuited across their lead-in wires after flashing. The lamps contain primer material at the bases of their bulbs and bridging across the inner ends of the lead-in wires. The primer material is a type having a low impedance after flashing, and the inner end regions of the lead-in wires are shaped to hold the flashed primer residue in place.

4 Claims, 4 Drawing Figures

FLASH LAMP ARRAY HAVING SHORTING LAMPS

CROSS-REFERENCES TO RELATED APPLICATIONS

Ser. No. 567,576, filed Apr. 14, 1975, Vaughn C. Sterling and Lewis J. Schupp, "Multiple Flash Lamp System," assigned the same as the present invention.

Ser. No. 571,264, filed Apr. 24, 1975, Paul T. Cote, "Photoflash Lamp Providing After-Flash Shorting," assigned the same as the present invention and issued as U.S. Pat. No. 4,039,273 on Aug. 2, 1977.

BACKGROUND OF THE INVENTION

The invention is in the field of photoflash lamps of the electrically fired type and designed to provide a short circuit, or relatively low impedance, across the lead-in wires after the lamps have been flashed. The invention also is in the field of multiple flash array circuits employing shorting lamps.

U.S. Pat. No. 3,532,931 to Paul Cote and John Harnden shows, in FIGS. 1 and 2, a type of flash lamp sequencing circuit utilizing switches that are normally open (or high impedance) and which close (or change to low impedance) upon flashing of the lamps, and the lamps must have open circuits (or high impedance) across their lead-in wires after flashing. FIG. 3 of the same patent shows a different type of flash lamp sequencing circuit, in which switches (such as fuses) initially have a low impedance and become open-circuited (or high impedance) upon flashing of the lamps, and the lamps must become electrically shorted (or have low impedance) across their leadin wires after flashing. The same patent describes the alternatives of employing lamps which reliably short upon flashing, and/or connecting switch devices across the lamps to achieve the same result in the sequencing circuit. U.S. Pat. No. 3,692,995 to Karl Wagner also shows a flash lamp sequencing circuit which employs opening switches and shorting lamps, and describes a type of shorting lamp in which the electrodes melt together. The above-referenced Sterling and Schupp patent application discloses a shorting lamp construction having a primer material, between the lead-in wires in the lamp, which ignites combustible material in the lamp in response to a firing voltage pulse, and the primer material thereupon forms a conductive residue which provides a short circuit, or relatively low impedance, across the lead-in wires.

The above-reference Coté patent application discloses shorting flash lamps in which an inlead wire is deformed by heat of flashing.

The lamps described above can be the so-called high voltage type of lamp which can be fired by a low energy voltage pulse of about 100 volts or more, and frequently in the range of about 1000 to 3000 volts such as can be produced by impacting a piezoelectric element. U.S. Pat. Nos. 2,972,937 and 3,106,080 to C. G. Suits disclose a high voltage flash lamp and a piezoelectric firing circuit.

SUMMARY OF THE INVENTION

Objects of the invention are to provide new and improved flash lamps of the shorting type which exhibit low impedance across the lead-in wires after the lamp has flashed, and which can be connected in sequential firing circuits, and which do not require glass beads to support the lead-in wires.

The invention comprises, briefly and in a preferred embodiment, a shorting type of flash lamp containing primer material at the base of the bulb and bridging across the inner ends of a pair of lead-in wires. The primer material has a low impedance after the lamp is flashed, and the inner end regions of the lead-in wires are bent over to hold the flashed primer residue in place and to provide improved electrical contact therewith.

DESCRIPTION OF THE PREFERRED EMBODIMENTS

Figure 1:
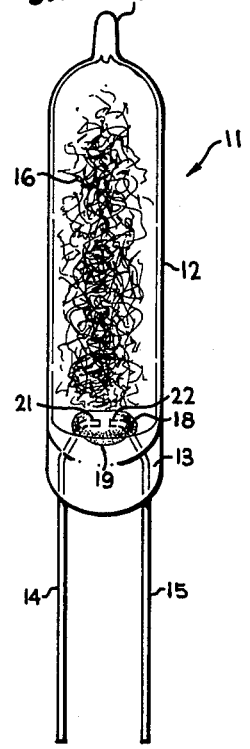
FIG. 1 is a side view of a photoflash lamp in accordance with a preferred embodiment of the invention.

The lamp 11 of FIG. 1 comprises a tubular envelope 12, preferably made of a borosilicate glass or other suitable vitreous material such as lead glass, and having a stem press seal 13 at one end thereof through which a pair of lead-in wires 14, 15 extend from the exterior to the interior of the bulb 12. The bulb 12 is partially filled with a loose mass of filamentary or shredded metal foil or wire 16 of zirconium or hafnium or other suitable combustible metal. Air is exhausted from the bulb 12, and the bulb is filled with oxygen at a pressure of at least several atmospheres, such as about 5 to 10 atmospheres, and the bulb is sealed off at an exhaust tip 17 at the other end thereof from the stem press seal 13.

Figure 2:
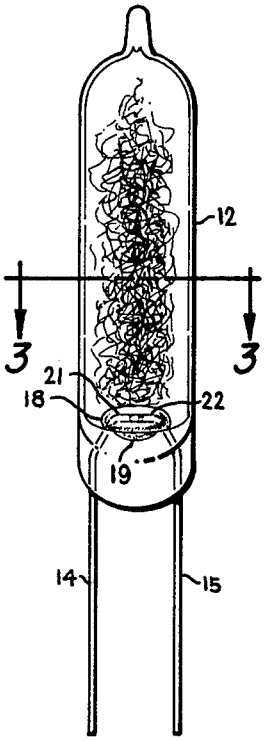
FIG. 2 is a side view of a photoflash lamp in accordance with an alternative preferred embodiment of the invention.
Figure 3:
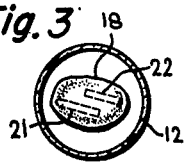
FIG. 3 is a cross-section view taken on the line 3—3 of FIG. 2.
Figure 4:
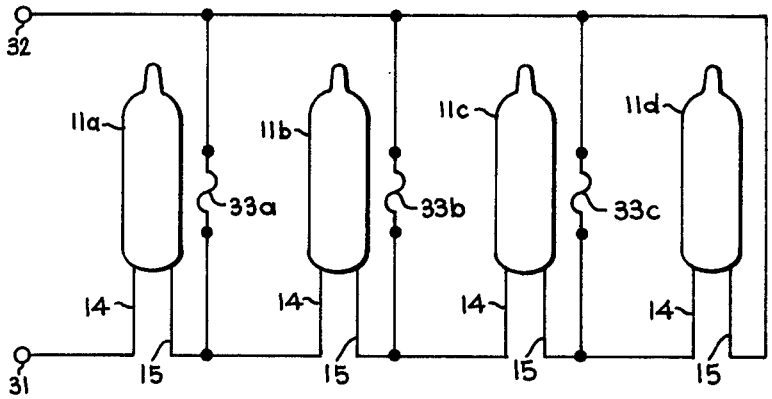
FIG. 4 is an electrical schematic diagram of a sequential firing circuit employing a plurality of the lamps of FIG. 1 or FIG. 3.

In accordance with the invention, primer material 18, of a type having low resistance after the lamp is flashed, is positioned in the bottom of the bulb 12 above the seal 13 and preferably in or partly in a recess 19 in the glass above the seal 13. The inner end regions 21 and 22 of the lead-in wires 14 and 15 are bent toward each other as shown in FIG. 1, or are bent at right angles and arranged in a mutually parallel and opposed manner as shown in FIGS. 2 and 3. The primer material 18 bridges across and is in contact with the inner end regions 21, 22 of the lead-in wires 14, 15. Suitable materials for the primer are disclosed in the above-referenced Sterling and Schupp patent application, and may comprise a mixture of powdered metal, oxidizer, and oxides, for example a mixture of zirconium powder, alkaline earth metal chlorates, barium chromate, and lead oxide. Preferably, the primer 18 covers the entire lead-in end regions 21 and 22 to prevent them from being shorted by the metal fill 16. When a firing voltage, such as 1000 volts or more which can be generated by impacting a small piezoelectric element in a camera, is applied to the lead-in wires 14 and 15, the primer material 18 ignites and causes the metal 16 to burn and cause a flash of light. Before flashing, the primer material 18 has a high resistance, such as a megohm or more, between the gap of about 1/16 of an inch between the inner ends of the lead-in wires, and after flashing, it has a low resistance, such as up to 10,000 ohms or more, so as to conduct the next firing voltage pulse to the next lamp to be flashed, in a circuit such as shown in FIG. 4. Since the firing pulse current is very low, and is substantially zero until the next lamp commences to flash, and the firing pulse voltage is rather high (3000 volts, for example), sufficient firing pulse energy will pass through the primer residues of several series-connected flashed lamps to flash the next lamp. The bent-over end regions 21 and 22 of the lead-in wires hold the flashed primer residue in place and provide an improved large-area electrical contact with it.

The sequential lamp flashing circuit of FIG. 4 has a pair of input terminals 31, 32 adapted to be connected to a source of electrical firing pulses, for example, firing pulses produced by stressing or impacting a piezoelectric element as described in the above-referenced Suits patents. A plurality of flash lamps 11*a*, 11*b*, 11*c*, and 11*d*, constructed as shown in FIG. 1 or FIG. 2, are arranged in desired manner in a housing unit or otherwise, and are connected electrically in series across the terminals 31 and 32, by means of their lead-in wires, as shown in FIG. 4. A plurality of fuses 33*a*, 33*b*, and 33*c* are respectively connected between the junctions of the series-connected flash lamps and one of the firing pulse terminals 32. Fuse 33*a* is located sufficiently near the lamp 11*a* so as to become open-circuited due to heat from the flashing of the lamp; similarly, fuses 33*b* and 33*c* are located sufficiently near lamps 11*b* and 11*c* so as to become open-circuited by heat radiated from these lamps when they are flashed. No fuse is required adjacent to the last lamp 11*d*, although there would be no harm in providing such a fuse.

Assuming that none of the lamps in FIG. 4 have yet been flashed, a first firing pulse applied across the terminals 31 and 32 will be applied across the lead-in wires 14 and 15 of lamp 11*a*, via the fuse 33*a*, thereby causing the lamp 11*a* to flash. Upon flashing of lamp 11*a*, heat radiated therefrom open-circuits the fuse 33*a*, and the lamp's primer residue provides a relatively low impedance, such as up to about 10,000 ohms, between its lead-in wires 14 and 15. Each firing pulse applied to the terminals 31 and 32 has sufficient energy to fire a single lamp; however, if desired, a pulse of greater energy or longer duration can be utilized in order to cause flashing of two or more lamps in quick succession, during the taking of a single picture to obtain a greater amount of illumination. When the next firing pulse is applied across terminals 31 and 32, energy therefrom passes through the primer residue of lamp 11*a*, and through the fuse 33*b*, to the lead-in wires 14 and 15 of lamp 11*b*, causing this lamp to flash, whereupon the heat therefrom causes the fuse 33*b* to become an open circuit and the lamp's primer material becomes a low impedance between the lamp's lead wires 14 and 15. The foregoing procedure is repeated until all of the lamps of the circuit have become flashed. The purpose of each of the fuses 33*a*, etc., is to provide an energy path for the firing pulse to be applied to its associated lamp, and thereafter to avoid short-circuiting succeeding firing pulses. The last lamp 11*d* need not be a shorting type.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. A shorting type of flash lamp comprising an elongated bulb containing combustible material and having a pair of lead-in wires sealed through a base of said bulb, the inner end regions of said lead-in wires being bent transverse to the length of said bulb and positioned in mutual side-by-side spaced apart relationship over said base, and a single mass of primer material contained in said bulb over said base thereof and bridging across and completely covering the bent end regions of the lead-in wires, said primer material being a type which leaves a relatively low resistance residue after the lamp is flashed.

2. A lamp as claimed in claim 1, in which the interior of said bulb is provided with a recess in said base at the region of said lead-in wires, said primer material being positioned at least in part in said recess.

3. A shorting type of flash lamp comprising an elongated bulb containing combustible material and having a pair of lead-in wires entering said bulb in substantially mutually parallel relationship, and primer material bridging across and in contact with the inner end regions of said lead-in wires within said bulb, said primer material being a type which leaves a relatively low resistance residue after the lamp is flashed, said inner end regions of the lead-in wires being bent over transverse to the length of said bulb and positioned in mutual side-by-side spaced apart relationship said bent end regions being completely covered with a single mass of primer material so as to hold said primer material and its after-flash residue in position.

4. A photoflash sequential lamp flashing arrangement comprising a plurality of flash lamps each having first and second lead-in wires and adapted to produce light and heat when flashed, first and second firing pulse input terminals, means connecting said lamps in electrical series arranged from a first lamp to a last lamp, means connecting the first lead-in wire of said first lamp to said first input terminal, means connecting the second lead-in wire of said last lamp to said second input terminal, each junction of said lamps constituting a connection of the second lead-in wire of the preceding lamp to the first lead-in wire of the succeeding lamp, and a plurality of fuses connected respectively between -aid junctions and said second input terminal, each of said fuses being positioned near the lamp to the second lead-in wire of which it is connected so as to become open-circuited by heat of the lamp when flashed, each of said lamps except not necessarily said last lamp comprising an elongated bulb through which its lead-in wires are sealed in substantially mutually parallel relationship, and primer material bridging across and in contact with the inner end regions of said first and second lead-in wires and having a relatively high impedance prior to flashing of the lamp and having the characteristic of having a relatively low impedance after the lamp is flashed, said inner end regions of the lead-in wires being bent over transverse to the length of said bulb and positioned in mutual side-by-side spaced apart relationship, said bent end regions being completely covered with a single mass of primer material to hold said primer material in place.

* * * * *